United States Patent [19]

Shay et al.

[11] 4,066,558

[45] Jan. 3, 1978

[54] LOW VISCOSITY SPIN FINISH SYSTEMS FOR NEAT FINISH APPLICATION

[75] Inventors: Barry M. Shay; Remo Santacecilia, both of Wilmington, Del.

[73] Assignee: ICI Americas Inc., Wilmington, Del.

[21] Appl. No.: 441,265

[22] Filed: Feb. 11, 1974

[51] Int. Cl.[2] ..... D06M 13/16; D06M 13/18; D06M 13/20

[52] U.S. Cl. ..... 252/8.9; 252/DIG. 1; 427/175; 428/378; 428/922

[58] Field of Search ..... 117/138.8, 139.5 F, 117/139.5 CQ; 252/8.8, 8.9, DIG. 1, DIG. 14, 170; 8/62; 428/378, 922

[56] References Cited

U.S. PATENT DOCUMENTS

| | | | |
|---|---|---|---|
| 2,803,565 | 8/1957 | Sagar | 117/139.5 |
| 2,824,832 | 2/1958 | Leupold et al. | 252/8.9 |
| 2,828,180 | 3/1958 | Sertorio | 8/62 |
| 3,101,323 | 8/1963 | Merlo et al. | 252/8.9 |
| 3,248,258 | 4/1966 | Coats | 252/8.9 X |
| 3,306,850 | 2/1967 | Olsen | 252/8.9 X |
| 3,338,830 | 8/1967 | Stokes et al. | 252/8.9 X |
| 3,341,451 | 9/1967 | Dziuba et al. | 252/8.6 |
| 3,341,452 | 9/1967 | Cooley | 252/8.9 |
| 3,421,935 | 1/1969 | Finch | 252/8.9 X |
| 3,428,560 | 2/1969 | Olsen | 252/8.7 |
| 3,493,504 | 2/1970 | Buckley | 252/8.8 |
| 3,575,856 | 4/1971 | Anton | 252/8.9 |

OTHER PUBLICATIONS

J. P. Redston et al., J. Amer. Oil Chem. Soc. 48 (2) July, 1971 pp. 344–348.

*Primary Examiner*—Allan Lieberman

[57] ABSTRACT

Clear, stable low viscosity yarn lubricating compositions consisting of 40–60 percent by weight of a low viscosity hydrophobic lubricant such as butyl stearate and hexadecyl stearate; 20–55 percent by weight of a hydrophilic lubricant such as polyoxyethylene(2–10-)fatty alcohols, polyoxyethylene(5–20)nonyl phenols, and polyoxyethylene(5–20)tridecyl alcohol; 5–15 percent by weight of selected antistats such as polyoxyethylene(8)lauric acid, polyoxyethylene(20)tallow amine, and polyoxyethylene(23)coconut fatty acid esters of glycerine, and from 0.1–5 percent of a polar coupling agent such as water, low molecular weight alcohols and low molecular weight alcohol-ethers are especially suitable for direct application in the processing of polyester and polyamide yarns.

5 Claims, No Drawings

LOW VISCOSITY SPIN FINISH SYSTEMS FOR NEAT FINISH APPLICATION

BACKGROUND OF THE INVENTION

This invention pertains to the man-made fibers art and, more particularly, to the fiber finish art. In the process of manufacturing synthetic textiles it is necessary, in order to successfully prepare the yarn, to treat it with a combination lubricant/antistat system commonly referred to as a spin finish. The spin finish is generally applied immediately after extrusion of the polymer prior to drawing. Troublesome electrostatic effects in combination with detrimental frictional behavior can be encountered during subsequent processing of the polymer if an improper spin finish is employed. The lubricant portion of the said spin finish provides a balanced blend of fiber-to-metal lubricity and fiber-to-fiber cohesiveness. The antistat portion contributes electrostatic protection to the fiber. Such spin finish systems have generally been applied to the textiles as a dilute aqueous emulsion requiring incorporation of suitable emulsifiers into the spin finish system. Recently, there has been an effort on the part of textile manufactures to improve the economics of the spin finish application by moving directly to spin finish compositions which require no pre-emulsification and dilution in large quantities of solvent prior to their application to the yarn. Such an application has been termed neat finish application in the art and is especially applicable to the processing of polyester yarns. However, this has brought about the added requirement of low viscosity as a prerequisite to satisfactory application of neat finish. Recent studies indicate that the use of aqueous spin finishes in the manufacture of polyester yarn can cause serious loss in yarn physical properties especially in strength related properties.

It is the object of this invention to provide clear, stable, low viscosity neat finish formulations which can be applied directly to yarn as low viscosity concentrates.

It is another object to provide a unique finish having a hydrophobic/hydrophilic lubricant combination.

PRIOR ART

The spin finishes of the present invention as well as those of the prior art are selected blends of lubricants, emulsifiers, coupling agents, antistatic agents, and other beneficiating additives such as antioxidants, softeners, dying agents and the like. Representative of compositions previously used in aqueous systems but having ingredients in common with the present invention are those found in U.S. Pats. Nos. 2,824,832; 3,101,323; 3,248,258; 3,306,850; 3,338,830; 3,341,451; 3,421,935; 3,428,560; 3,493,504; 3,575,856; and articles such as by J. P. Redston, W. F. Bernholz and R. C. Nahta, J. Amer. Oil Chem. Soc. 48 (2) July, 1971, pages 344–348. These prior formulations are inadequate in that their viscosity is not sufficiently low to permit their application directly to the fiber at the desired finish level.

DESCRIPTION OF THE INVENTION

The fiber lubricant compositions of the present invention comprise 40–60 percent of a hydrophobic lubricant having a viscosity in the range of 20–60 centipoises; 5–15 percent by weight of an antistat having a viscosity in the range of 25–110 centipoises; 20–55 percent by weight of a hydrophilic lubricant haing viscosities in the range of 35–110; and up to 5 percent by weight of a polar coupling agent. The preferred blends of the spin finish must have a viscosity in the range of 35–60 centipoises measured at 76° F. and a pour point of no greater than 25° F.

The hydrophobic textile lubricants used in the formulation of the invention can be selected from stearates of monohydric alkyl alcohols having from 4–16 carbon atoms ranging from butyl to hexadecyl alcohol and preferably butyl and isocetyl.

As hydrophilic lubricants, the formulas of the invention contain 20–55 percent by weight of the following: polyoxyethylene (2–10) derivatives of monohydric fatty alcohols having 10–20 carbon atoms; polyoxyethylene(-5–20)nonyl phenols; and polyoxyethylene(5–20) tridecyl alcohol. These lubricants may be stabilized by the addition of antioxidants to prevent deterioration.

The antistatic agents employed in the formulation of the invention are selected from polyoxyethylene(8)lauric acid, polyoxyethylene(20)tallow amine, and polyoxyethylene(23)fatty acid esters of glycerine derived from coconut oil. Fatty acids derived from coconut products consists of caprylic, capric, lauric, myristic, palmitic, stearic, oleic, and linoleic acids.

The above emulsifiers and antistatic agents are condensation products of ethylene oxide. For example, polyoxyethylene(8)lauric acid is a condensation of one mol of lauric acid with 8 mols of ethylene oxide. Polyoxyethylene(20)tallow amine is a condensation product of 20 mols of ethylene oxide with one mol of mixed monalkyl amines having 16 and 18 carbon atoms.

The formulations are usually made by first blending together the lubricant, antistat, and emulsifier and thereafter adding a minor amount, usually from 0.1–5 percent by weight, of a polar coupling agent such as water, ethanol, or a low molecular weight hydroxy ether such as ethylene glycol monoethyl ether (Cellosolve ®).

The following examples illustrate the improvements and advantages offered by the formulations of the invention:

EXAMPLE 1

A clear, light yellow liquid is formed by blending together 56.45 parts hexadecyl stearate, 18.81 parts polyoxyethylene(2)oleyl alcohol; 9.4 parts polyoxyethylene(8)lauric acid; 4.7 parts polyoxyethylene(4)lauryl alcohol (purified and stabilized)*, 4.7 parts polyoxyethylene(20)tallow amine; 5 parts poloxyethylene(9.2-)nonyl phenol and 0.94 parts water.

*Purified and Stabilized POE(4)Lauryl Alcohol meets the following specifications:

EXAMPLE 2

A pale yellow, clear liquid is obtained by blending 54.8 parts hexadecyl or isocetyl stearate, 18.26 parts polyoxyethylene(2)oleyl alcohol, 9.13 parts polyoxyethylene(8)lauric acid, 4.57 parts polyoxyethylene(4)lauryl alcohol; 4.57 parts polyoxyethylene(23)coconut fatty acid ester of glycerine; 4.9 parts polyoxyethylene(15)tridecyl alcohol and 3.77 parts of a 3/1 water/ethylene glycol butyl ether blend.

EXAMPLE 3

A colorless, clear blue-white liquid is prepared by blending 58.82 parts isocetyl stearate; 21.57 parts polyoxyethylene(8)lauric acid; 7.85 parts polyoxyethylene(2)oleyl alcohol; 4.9 parts polyoxyethylene(4-

)lauryl alcohol — refined* and stabilized; 4.9 parts polyoxyethylene(9.2)nonyl phenol; and 1.96 parts water.

EXAMPLE 4

A colorless, clear liquid is prepared by blending 55.0 parts isocetyl stearate; 21.6 parts polyoxyethylene(8-)lauric acid; 7.8 parts polyoxyethylene(2)oleyl alcohol; 4.9 parts polyoxyethylene(4)lauryl alcohol*, 4.9 parts polyoxyethylene(9.2)nonyl phenol; 1 part of an antioxidant TOPANOL CA® (a condensate of 3 mols, 3 methyl-6-tertiary butyl phenol with 1 mol crotonaldehyde as described in U.S. Pat. No. 3,196,185); and 4.8 parts water.

| | |
|---|---|
| Acid No. | 0.5 max. |
| Saponification No. | 0–2 |
| Hydroxyl No. | 145–160 |
| Color (H.I.) | 3 max. |
| % Water | 0.5 max. |
| Clairty | clear at 25° C. |
| pH (5% sol) | 5.5–7.5 |

Contains as Antioxidant Stabilizer System:
Butylated Hydroxyanisole/citric acid monohydrate in 2/1 ratio.

Physical characteristics and stability measurements are shown in Table I for Examples 1–4.

Antistatic properties imparted by the finish are determined by measuring electrical resistance of polyester taffeta fabric (Testfabrics Inc. style #704). Fabric is conditioned overnight at 40 percent R.H. at 75° F. prior to measuring its resistivity properties on a Beckman Ultrohmeter. Finishes are applied by the padding method employing a wet pickup condition of 25 percent at a padder pressure of 35 lbs. and a solution temperature of 50° C. The following results are obtained:

TABLE I

| Finish of Example | Application Level (%) | Resistivity Ohms/Square | Log of R |
|---|---|---|---|
| 1 | 0.25 | $4.25 \times 10^{11}$ | 11.63 |
| | 0.50 | $2.78 \times 10^{11}$ | 11.44 |
| | 0.75 | $2.01 \times 10^{11}$ | 11.30 |
| 2 | 0.25 | $5.71 \times 10^{11}$ | 11.76 |
| | 0.50 | $3.57 \times 10^{11}$ | 11.55 |
| | 0.75 | $2.33 \times 10^{11}$ | 11.37 |
| 3 | 0.25 | $3.5 \times 10^{11}$ | 11.54 |
| | 0.50 | $3.06 \times 10^{11}$ | 11.49 |
| | 0.75 | $2.78 \times 10^{11}$ | 11.44 |
| 4 | 0.5 | $2.49 \times 10^{11}$ | 11.40 |
| Distilled Water (Control) | — | $10^{15}$ | 15 |

Polyester yarn samples 250/50/0 having the above finishes applied by the kiss roll method are conditioned overnight at 65% R.H. and 70° F. prior to determining their frictional properties at room temperature using a friction tester (U.S. Pat. No. 3,366,299) having a one centimeter diameter stainless steel pin, a yarn contact angle of 180°, at yarn speeds of 10, 50, and 100 meters per minute. The coefficient of hydrodynamic friction ($f$) is calculated from the belt formula $T_2/T_1 = e^{f\theta}$ where ($T_1$) is the input tension of 15 grams maintained on the yarn in advance of the pin, ($T_2$) is the output tension on the arm measured on the strain gage after passing the pin, $\theta$ is the angle of contact (in radians) and (e) is the Napierian logarithum base. (See Table III)

Yellowing characteristics are determined by visual ratings on knitted nylon-6 200/32, 1/2Z, B, treated with the blends of Examples 1–3. Swatches of nylon are treated with finish such that the add-on is equivalent to 1.8 percent. The material is then oven treated at 300° F. for 15 minutes. The materials are rated on a scale of 1 through 4 with a rating of 1 being the least yellowed. (See Table IV)

TABLE II

| Finish of Example | Viscosity[1] cps. 25° C | Volatility[2] | Freeze-Thaw[3] Stability | 140° F[4] Stability |
|---|---|---|---|---|
| 1 | 37 | 4% | Excellent | Excellent |
| 2 | 41 | 7% | Excellent | Excellent |
| 3 | 55 | 6% | Excellent | Excellent |
| 4 | 63 | — | Excellent | Excellent |

[1]As determined on a Brookfield Viscometer (Model LVT) using Spindle #1 at 60 R.P.M.
[2]As determined in a gravity convection oven after 5 g. sample exposure for 2 hours at 200° C.
[3]As determined after 3 freeze thaw cycles between 5° C. and room temperature.
[4]As determined by exposing 100 g. sample in 4 oz. capped jar at 140° F. for at least 24 hours.

TABLE III

| Finish of Example | Application Level | Solvent | $T_f$(g) Y-Y 1 cm/min | Y-Metal (S.S.) 10 | 50 | 100 m/min |
|---|---|---|---|---|---|---|
| 1 | 0.75 | I.P.A. | 21 ± 13 | 34 | 70 | 96 |
| 2 | 0.75 | Water | 20 ± 15 | 42 | 68 | 48 |
| 3 | 0.75 | I.P.A. | 23 ± 15 | 30 | 44 | — |
| 4 | 0.5 | Water | 24 ± 14 | 76 | 180 | 208 |
| But. Stearate (Control) | 0.5 | I.P.A. | 25 ± 15 | 44 | 62 | 80 |

Y-Y: 1 cm/min., 15 g. $T_1$, 1080°
Y-SS: 10,50 and 100 m/min., 15 g. $T_1$, 180°

TABLE IV

| Finish of Example | Application Level (%) | Ratings (Avg.) |
|---|---|---|
| 1 | 1.8 | 1.7 |
| 2 | 1.8 | 1.3 |
| 3 | 1.8 | 1.0 |
| Control Finish* | 1.8 | 3.8 |

*32% POE (10) Oleic Acid
25% POE (25) Castor Oil
2% Sorbitan Monooleate
38% Wonder Oil
3% Water

What is claimed is:

1. A clear, stable yarn lubricating composition having a viscosity in the range of 35–65 centipoises as determined on a Brookfield Viscometer Model LVT using Spindle 1 at 60 R.P.M. at 75° F. which consists essentially of:

a. 40–60 percent by weight of a hydrophobic lubricant having a viscosity in the range of 20–60 centipoises selected from stearates of monohydric alkyl alcohols having from 4–16 carbon atoms, b. 20–55 percent by weight of a hydrophilic lubricant having a viscosity in the range of 35–110 1 centipoises selected from the group consisting of polyoxyethylene(2–10)monohydric fatty alcohols having 10–20 carbon atoms, polyoxyethylene(5–20) nonyl phenols, and polyoxyethylene(5–20)tridecyl alcohols, c. 5–15 percent by weight of an antistat having a viscosity in the range of 25–110 centipoises selected from polyoxyethylene(8)lauric acid, polyoxyethylene(20)tallow amine, and polyoxyethylene(23)fatty acid esters of glycerine wherein said fatty acids have 8–18 carbon atoms, and d. 0.1% to 5 percent by weight of a polar coupling agent selected from the group consisting of water, ethanol, or a low molecular weight glycol ether.

2. A composition of claim 1 wherein said hydrophobic lubricant is selected from the group consisting of butyl stearate and isocetyl stearate.

3. A composition of claim 1 wherein said hydrophilic lubricant is polyoxyethylene(4)lauryl alcohol.

4. A composition of claim 3 wherein said polyoxyethylene(4)lauryl alcohol is a clear product having an acid number no greater than 0.5 and contains a minor amount of an antioxidant system consisting of 2 parts butylated hydroxyanisole and 1 part citric acid monohydrate.

5. A colorless, clear liquid blend consisting essentially of 55.0 parts isocetyl stearate; 21.6 parts polyoxyethylene(8)lauric acid; 7.8 parts polyoxyethylene(2)oleyl alcohol; 4.9 parts polyoxyethylene(4)lauryl alcohol; having an acid number of 0.5 maximum, a saponification number in the range of 0–2, a hydroxyl number in the range of 145–160, a color (HI) of 3 max., a water concentration of 0.5 max., and a pH (5% solution) of 5.5–7.5 and an antioxidant stabilizer system comprising butylated hydroxyanisole/citric acid monohydrate in a 2/1 ratio; 4.9 parts polyoxyethylene(9.2)nonyl phenol; 1 part of an antioxidant and 4.8 parts water.

* * * * *

UNITED STATES PATENT AND TRADEMARK OFFICE

CERTIFICATE OF CORRECTION

PATENT NO. : 4,066,558

DATED : January 3, 1978

INVENTOR(S) : Barry M. Shay and Remo Santacecilia

It is certified that error appears in the above-identified patent and that said Letters Patent are hereby corrected as shown below:

Column 3, line 14, insert -- (POE(4)Lauryl Alcohol Specs) --.
Column 3, line 46, "TABLE I" should read -- TABLE II --.
Column 4, line 14, "TABLE II" should read -- TABLE I --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*